US007143833B2

(12) United States Patent
Gaidano et al.

(10) Patent No.: US 7,143,833 B2
(45) Date of Patent: Dec. 5, 2006

(54) PORTABLE FIRE-EXTINGUISHER

(75) Inventors: Giovanni Gaidano, Pecetto Torinese (IT); Giuseppe Lavesi, Pino Torinese (IT)

(73) Assignee: Euro Spare Parts S.R.L., Turin (IT)

( * ) Notice: Subject to any disclaimer, the term of this patent is extended or adjusted under 35 U.S.C. 154(b) by 269 days.

(21) Appl. No.: 10/860,541

(22) Filed: Jun. 2, 2004

(65) Prior Publication Data

US 2004/0262017 A1 Dec. 30, 2004

(30) Foreign Application Priority Data

Jun. 4, 2003 (IT) ..... TO2003A0414
Oct. 14, 2003 (IT) ..... TO2003A0802

(51) Int. Cl.
*A62C 11/00* (2006.01)

(52) U.S. Cl. ..... 169/30; 169/56; 169/57; 169/77; 169/84; 169/26; 169/27; 169/11; 169/12

(58) Field of Classification Search ..... 169/56, 169/57, 58, 59, 77, 84, 26.27, 28, 9, 11, 12, 169/DIG. 3
See application file for complete search history.

(56) References Cited

U.S. PATENT DOCUMENTS

| | | | | |
|---|---|---|---|---|
| 543,341 | A * | 7/1895 | Hughes et al. | 169/26 |
| 798,142 | A | 8/1905 | Myers | |
| 1,390,945 | A * | 9/1921 | Wenzelmann | 169/26 |
| 1,826,819 | A | 10/1931 | Parsons et al. | |
| 2,220,299 | A * | 11/1940 | Stover | 169/26 |
| 2,220,407 | A * | 11/1940 | Nelson | 246/488 |
| 2,496,160 | A * | 1/1950 | Hesson | 169/30 |
| 3,889,758 | A * | 6/1975 | Dunn | 169/74 |
| 3,942,445 | A | 3/1976 | Baker et al. | |
| 5,425,426 | A | 6/1995 | Baratov et al. | |
| 5,660,236 | A * | 8/1997 | Sears et al. | 169/72 |
| 5,848,649 | A * | 12/1998 | Matsumoto et al. | 169/26 |
| 6,024,889 | A * | 2/2000 | Holland et al. | 252/5 |
| 6,170,399 | B1 * | 1/2001 | Nielson et al. | 102/336 |
| 6,394,522 | B1 * | 5/2002 | Ingoldt | 294/143 |
| 6,622,801 | B1 * | 9/2003 | Rondino | 169/71 |

FOREIGN PATENT DOCUMENTS

| | | |
|---|---|---|
| GB | 2 028 127 A | 8/1978 |
| RU | 2 043 778 C1 | 9/1995 |
| RU | 2 099 113 C1 | 12/1997 |
| WO | WO 00/37142 | 6/2000 |

* cited by examiner

*Primary Examiner*—Eric Keasel
*Assistant Examiner*—Trevor McGraw
(74) *Attorney, Agent, or Firm*—Merchant & Gould P.C.

(57) ABSTRACT

A portable aerosol fire-extinguisher has an elongate metal casing (3) with a handle (2) and an internal chamber (4) for housing a charge (5) of a solid substance which can be transformed, at a predetermined temperature, into an aerosol with flame-extinguishing properties, and which is delivered through an opening (7). An inflammable charge (13) which can be ignited by means of an activation element (14, 16) is provided for triggering the reaction of the extinguishing charge (5). The activation element can be operated manually in order to produce friction between the inflammable charge (13) and the activation element (14, 16), such as to bring about ignition of the inflammable charge (13).

11 Claims, 2 Drawing Sheets

PORTABLE FIRE-EXTINGUISHER

The present invention relates to a portable aerosol fire-extinguisher of the type comprising a hollow casing defining in its interior a chamber for housing a solid substance which can be transformed, at a predetermined temperature, into an aerosol with flame-extinguishing properties, and which can be discharged in aerosol form through an opening which puts the chamber housing the extinguishing charge into communication with the exterior. A portable fire-extinguisher of the above-mentioned type is known, for example, from patent publication WO-00/37142.

In devices of this type, an electrical resistor, supplied by batteries via a switch, is provided for triggering the transformation of the extinguishing charge from solid to aerosol. Fire-extinguishers of the above-mentioned type have a disadvantage which is connected with the limited endurance of the batteries over time. As is known, batteries in fact become discharged after a number of months and, unless the user remembers to replace them periodically, there is a risk that the fire-extinguisher will not operate when required because the batteries are discharged.

The object of the invention is therefore to provide a portable fire-extinguisher of the type specified above, addressing principally the problem of ensuring reliability of operation over time and the capacity to be activated very quickly when required.

These and other objects and advantages which will be understood better from the following description are achieved, according to the invention, by a portable aerosol fire-extinguisher as defined in the appended claims.

Figure 1:
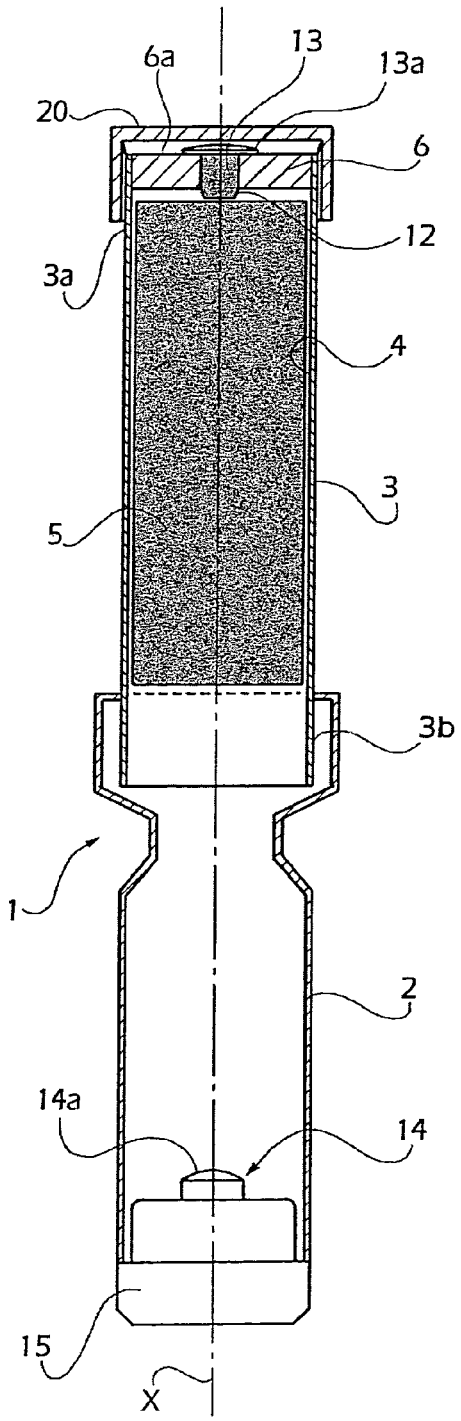
Figure 2:
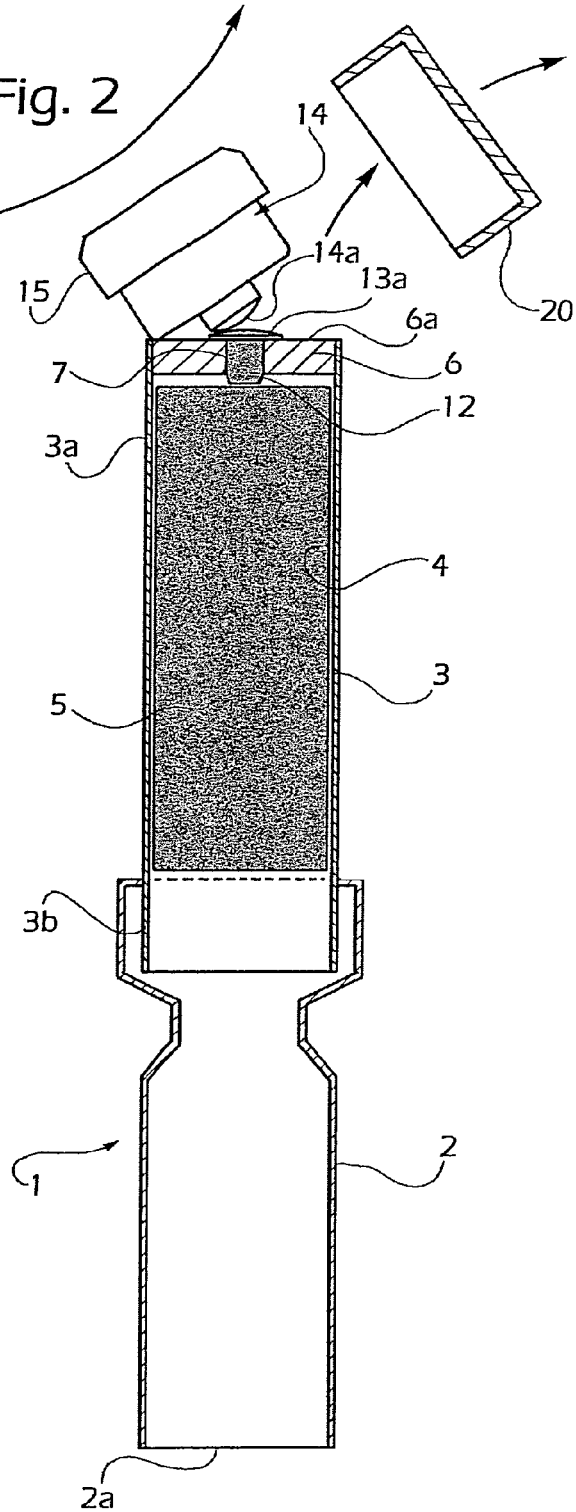
Figure 3:
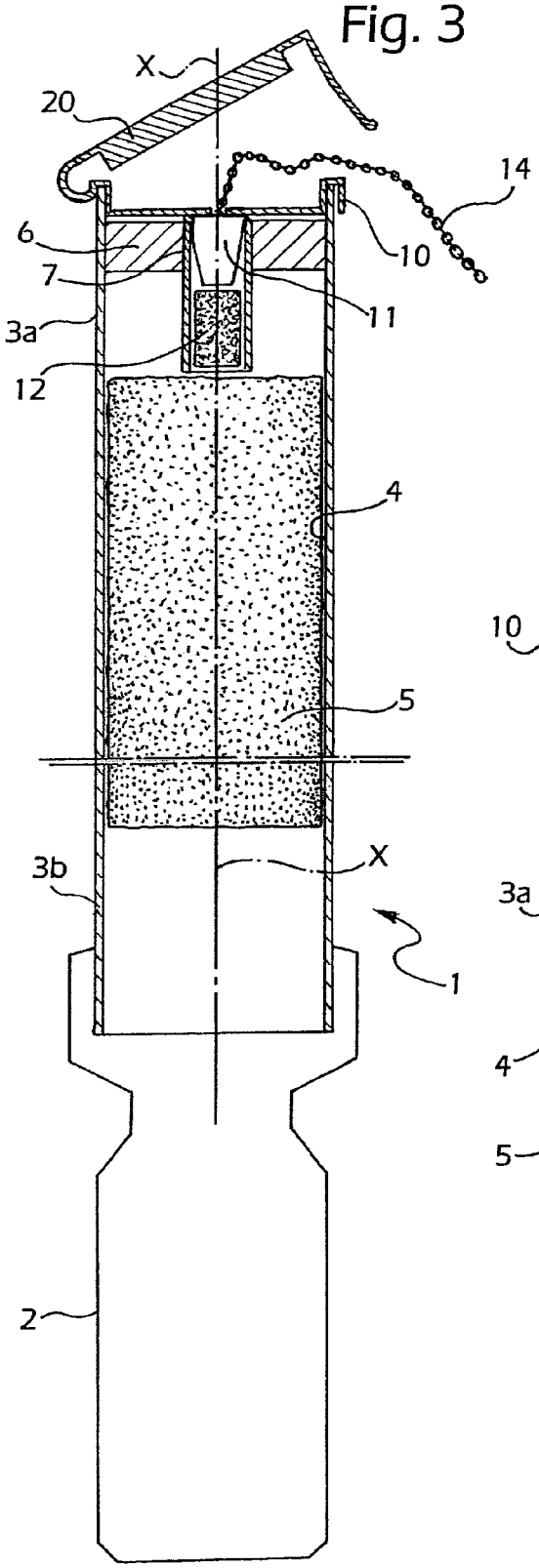
Figure 4:
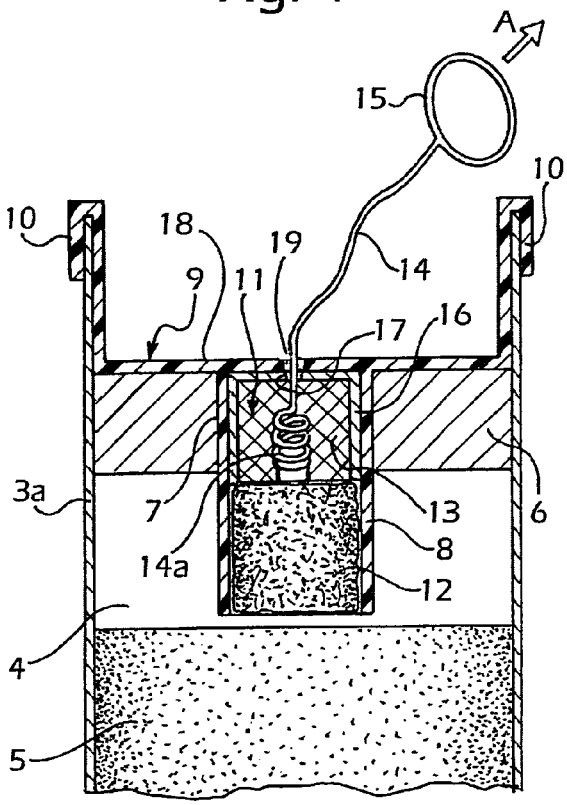

The structural and functional characteristics of two preferred but non-limiting embodiments of a portable fire-extinguisher according to the invention will now be described; reference is made to the appended drawings, in which:

FIG. 1 is a schematic view, in axial longitudinal section, of a first embodiment of a portable fire-extinguisher according to the invention in an inactive condition, FIG. 2 is a view of the portable fire-extinguisher of FIG. 1 in an activation stage, FIG. 3 is a schematic view, in axial longitudinal section, of a second embodiment of a portable fire-extinguisher according to the invention, and FIG. 4 is a view of a detail of FIG. 3 on an enlarged scale.

With reference initially to FIG. 1, a portable fire-extinguisher, generally indicated 1, comprises a handle 2 made of plastics material and an elongate tubular casing 3, having a distal end 3*a* and a proximal end 3*b* which is fixed to the handle 2. A chamber 4 is defined in the casing 3 for housing a charge 5 of a solid substance which can be transformed, at a predetermined temperature, into an aerosol with flame-extinguishing properties.

The chemical and physical characteristics of the extinguishing charge 5 are not relevant per se for the purposes of an understanding of the invention and will therefore not be described in detail herein. By way of indication, the extinguishing charge is a compacted mixture comprising potassium nitrate, a binding resin, and an organic oxidizing agent.

A transverse baffle or wall 6 is fixed at the distal end 3*a* of the tubular casing 3 and forms a central delivery opening or nozzle 7 which, when left empty, puts the internal chamber 4 into communication with the exterior. Preferably, both the casing 3 and the baffle 6 are made of metal, for example, aluminium.

Terms indicating directions and orientations, such as "longitudinal" and "transverse" or "axial" and "radial" are intended to be understood herein with reference to the longitudinal central axis X of the fire-extinguisher. Similarly, terms such as "front" and "rear" refer to the distal portion and to the proximal portion of the fire-extinguisher, respectively, with reference to the condition of normal use in a user's hands.

In order to trigger the reaction of the extinguishing charge 5, an inflammable charge 13 is inserted and held firmly in the opening 7; an outer surface 13*a* of the charge 13 projects or is arranged level with the outer surface 6*a* of the baffle 6 and in any case is accessible from the exterior. A delay fuse or slow match 12 may optionally be associated with the inflammable charge 13 in a position directly on the inner or rear side thereof, interposed between the inflammable charge 13 and the extinguishing charge 5. A protective cover 20 closes the distal end of the fire-extinguisher to protect the inflammable charge 13 from moisture, dirt and damage due to knocks.

In the inactive or rest condition of FIG. 1, an element 14 for activating the inflammable charge 13 is held in the base opening 2*a* of the handle 2 in a protected position and remote from the inflammable charge 13. The activation element 14 comprises a surface 14*a* which is rough or suitably prepared with a mixture (e.g. a phosphoric mixture) such that, if it is rubbed on the inflammable charge 13, it brings about ignition thereof substantially in accordance with the operating principal of a match.

The term "inflammable charge" is intended to include all types of substances or solid mixtures which can be ignited by friction. The list of such substances or mixtures of substances includes, in non-limiting manner, phosphoric mixtures, for example, containing phosphorus sesquisulphide, oxidizing substances (e.g. potassium chlorate, potassium chromate and dichromate, manganese oxide), inert substances suitable for promoting friction during rubbing (e.g. glass dust, fossil flour, etc.), adhesives (glues) and, optionally, combustible substances (e.g. sulphur, resins). Charges of the type known in the pyrotechnics field may also be used for the composition of the inflammable charge 13. In the preferred embodiment shown in FIGS. 1 and 2, the activation element 14 is fixed to a manual gripping means 15 formed as a plug which closes the base opening 2*a* of the handle 2.

The fire-extinguisher shown in FIGS. 1 and 2 operates as follows. When the user sees the need, he removes the cover 20 (FIG. 2) to expose the inflammable charge 13, pulls out the plug 15, and rubs the rough surface 14*a* against the outer surface 13*a* of the inflammable charge, as indicated by the arrows in FIG. 2. The friction due to the rubbing of the surfaces 14*a* and 13*a* causes ignition of the inflammable charge 13 and the production of a flare which lights the fuse 12. The fuse, which burns for a few seconds (3–4 seconds), gives the user time to move his hand away from the distal end of the fire-extinguisher before the extinguishing aerosol starts to be discharged. When the combustion which is propagated along the fuse 12 reaches the extinguishing charge 5, it triggers the chemical reaction thereof. As is known, when the mixture of potassium salts constituting the charge 5 is brought to a temperature of about 300° C., an exothermic reaction is initiated and produces an aerosol suspension of minuscule particles. As a result of the increase in pressure which accompanies the reaction, the aerosol fluid produced by the combustion of the extinguishing charge is discharged energetically from the opening 7 and can be directed towards the fire. The aerosol particles are spread over the source of a fire, inhibiting the combustion-supporting effect of oxygen and suffocating the propagation of the fire.

Reference will now be made to the variant shown in FIGS. 3 and 4, with the use of the same reference numerals to indicate parts the same as or corresponding to those already described with reference to FIGS. 1 and 2. A sleeve-like portion 8 of a plug, generally indicated 9, is inserted in the opening 7. The plug 9, which is preferably made of plastics material, is held on the distal end of the tubular casing 3 by means of a peripheral rim 10 and by radial interference between the delivery opening 7 and the central sleeve-like portion 8. In this portion, a starting capsule, generally indicated 11, is held in an outer or front position, and an associated delay fuse 12 is held in a position immediately further in or to the rear, interposed between the capsule 11 and the extinguishing charge 5.

The starting capsule 11 includes a small inflammable charge 13 arranged closely in contact with the end portion 16*a* of a manually-operable activation element 16, for example, a metal wire, a cord, or the like, which the user can pull by gripping a gripping ring 16*b*. The inflammable charge 13 is contained in a thin inverted cup-shaped container 17, the base of which has a central hole 17*a* for the insertion of the cord 16. The plug 9 has a transverse wall 18 with a hole 19 aligned with the hole 17*a* in the container 17. A protective cover 20 closes the distal end of the fire-extinguisher to protect the starting capsule 11 and its activation element 16.

The fire-extinguisher of FIGS. 3 and 4 operates as follows. When required, the user opens the cover 20, grips the gripping ring 16*b*, and pulls the cord 16 energetically in the direction indicated by the arrow A. The friction exerted by the end portion 16*a* of the activation element against the inflammable charge 13 brings about ignition thereof and the production of a flare which lights the fuse 12. In the embodiment of FIG. 4, the end portion 16*a* is wound in a helix; when the gripping ring 16*b* is pulled, the end portion of the wire is unwound, exerting friction which causes the inflammable charge 13 to ignite.

The fuse, which burns for a few seconds, gives the user time to move his hand away from the distal portion of the fire-extinguisher before the extinguishing aerosol starts to be discharged. When the combustion, which is propagated along the fuse 12, reaches the extinguishing charge 5, it triggers the exothermic chemical reaction thereof, with the production of an aerosol suspension of particles of extremely small particle size. The increase in pressure which accompanies the reaction causes the expulsion of the plug 9. The aerosol fluid produced by the combustion of the extinguishing charge is discharged energetically from the opening 7 and can be directed towards the fire.

As will be appreciated, the effectiveness of the fire-extinguisher according to the invention can be guaranteed for a much longer period of time than in conventional fire-extinguishers of the type discussed in the introductory portion of this description and the fire-extinguisher does not require any maintenance or periodic checks.

What is claimed is:

1. A portable aerosol fire-extinguisher, comprising: an elongate metal casing with a distal end, a proximal end fixed to a handle, and an internal chamber for housing a charge of a solid substance which can be transformed, at a predetermined temperature, into an aerosol with flame-extinguishing properties, a delivery opening in the region of the distal end for putting the chamber into communication with the exterior, and starting means disposed in the vicinity of the extinguishing charge for triggering the reaction thereof, wherein the starting means comprise an inflammable charge which is ignited by means of an activation element which is enclosed in an inactive condition and is moved manually in order to produce friction between the inflammable charge and the activation element to ignite the inflammable charge, wherein the delivery opening is formed in a transverse baffle in the distal end region of the casing, and wherein said inflammable charge is held in the delivery opening in the transverse baffle.

2. The fire-extinguisher of claim 1, wherein the activation element is provided with a surface which is rough or suitably prepared with a mixture and is configured to rub against a surface of the inflammable charge and ignite the inflammable charge.

3. The fire-extinguisher of claim 2, wherein the activation element is associated with the fire-extinguisher in a manner such that, in an inactive condition, the activation element is held remote from the inflammable charge and, in an active condition, can be brought into contact with a surface of the inflammable charge in order to ignite it by friction.

4. The fire-extinguisher of claim 1, wherein the inflammable charge includes at least one substance or a mixture of substances selected from the group consisting of: phosphoric mixtures, phosphorus sesquisulphide, oxidizing substances such as potassium chlorate, potassium chromate and dichromate, manganese oxide, inert substances suitable for promoting friction during rubbing, such as glass dust, fossil flour, adhesives such as glues, combustible substances such as sulphur, resins.

5. The fire-extinguisher of claim 1, wherein the extinguishing charge is a compacted mixture comprising potassium nitrate, a binding resin, and an organic oxidizing agent.

6. The fire-extinguisher of claim 1, wherein the outer surface of the inflammable charge projects or is arranged level with an outer surface of the transverse baffle.

7. The fire-extinguisher of claim 1, further comprising a protective cover mounted removably on the distal end of the casing to protect the inflammable charge in an inactive condition.

8. The fire-extinguisher of claim 3, wherein the activation element is fixed to a manual gripping means mounted removably on the fire-extinguisher.

9. The fire-extinguisher of claim 8, wherein the activation element is formed as a plug which can be inserted in a cavity of the handle in order to hold the surface in a position in which it is protected from the exterior in the inactive condition.

10. The fire-extinguisher of claim 1, further comprising a delay fuse interposed between the inflammable charge and the extinguishing charge.

11. The fire-extinguisher of claim 1, wherein the inflammable charge is held on the transverse baffle.

* * * * *